US006896063B2

(12) United States Patent
Chang et al.

(10) Patent No.: US 6,896,063 B2
(45) Date of Patent: May 24, 2005

(54) METHODS OF USING DOWNHOLE POLYMER PLUG

(75) Inventors: Benjamin Tai-An Chang, Houston, TX (US); Jane Qing Zhang, Sugar Land, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/408,476

(22) Filed: Apr. 7, 2003

(65) Prior Publication Data

US 2004/0194959 A1 Oct. 7, 2004

(51) Int. Cl.[7] ..... E21B 23/00

(52) U.S. Cl. ..... 166/386; 166/135; 166/192

(58) Field of Search ..... 166/288, 294, 166/295, 386, 300, 135, 192, 193, 195

(56) References Cited

U.S. PATENT DOCUMENTS

| | | | | |
|---|---|---|---|---|
| 3,385,367 A | * | 5/1968 | Kollsman | 166/191 |
| 3,613,784 A | | 10/1971 | Bassani | |
| 4,137,970 A | * | 2/1979 | Laflin et al. | 166/292 |
| 4,270,761 A | * | 6/1981 | Hertz, Jr. | 166/191 |
| 4,339,000 A | | 7/1982 | Cronmiller | |
| 4,380,916 A | | 4/1983 | Tanaka | 72/7 |
| 4,443,132 A | * | 4/1984 | Kotulla et al. | 405/259.5 |
| 4,936,386 A | * | 6/1990 | Colangelo | 166/292 |
| 5,078,211 A | * | 1/1992 | Swineford | 166/202 |
| 5,190,109 A | | 3/1993 | Pardo | 166/387 |
| 5,311,940 A | * | 5/1994 | LaFleur | 166/152 |
| 5,431,831 A | | 7/1995 | Vincent | 252/29 |
| 5,833,001 A | | 11/1998 | Song et al. | 166/287 |
| 6,062,315 A | | 5/2000 | Reinhardt | 166/381 |
| 6,102,120 A | | 8/2000 | Chen et al. | 166/287 |
| 6,422,575 B1 | * | 7/2002 | Czaplicki et al. | 277/628 |
| 6,478,088 B1 | | 11/2002 | Hansen et al. | 166/285 |
| 6,478,090 B2 | | 11/2002 | Deaton | 166/363 |
| 2002/0096330 A1 | | 7/2002 | James et al. | |

FOREIGN PATENT DOCUMENTS

| | | | |
|---|---|---|---|
| DE | 4122811 | 1/1993 | E21B/33/12 |
| EP | 0 363 920 A3 | 4/1988 | B29C/61/06 |

(Continued)

OTHER PUBLICATIONS (Author Unknown) "Ohio Department of Transportation Policy for Sealing of Geotechnical Exploratory Boreholes (Appendix G)"; Nov. 1, 1995, pp. G1–G17.

(Author Unknown) "Bentonite Well Plugging Technique Reduces Plugging and Abandonment Costs"; Feb. 1998; Rocky Mountain Oilfield Testing Center/Field Applications.

(Author Unknown) "Liner Hangers"; Baker Oil Tools.

*Primary Examiner*—John Kreck

(57) ABSTRACT

Disclosed is a method of either plugging or lining a wellbore or casing using a polymer member into which stored energy or shape memory has been introduced. The shape memory is introduced into the member by reducing its diameter, such as by compressing the member using a rolling mill machine or stretching the member axially. Next, the member is lowered into a desired location in the wellbore or casing and subjected to conditions causing at least partial recovery of the anelastic strain. The conditions causing recovery of the anelastic strain can include heat from the reservoir surrounding the wellbore, heat introduced into the wellbore, solvents, and combinations thereof. Recovery of the anelastic strain causes the member to expand in diameter, thus plugging or lining the wellbore or casing at the desired location.

18 Claims, 5 Drawing Sheets

FOREIGN PATENT DOCUMENTS

| | | | |
|---|---|---|---|
| EP | 0 363 920 A2 | 10/1989 | B29C/61/06 |
| FR | 2717855 | 2/1996 | E21B/17/00 |
| FR | 2737534 | 10/1999 | E21B/43/10 |
| FR | 2780751 | 1/2000 | E31B/29/10 |
| FR | 2790534 | 9/2000 | B29B/15/12 |
| GB | 2 284 222 A | 5/1995 | E21B/33/04 |
| GB | 2 308 395 A | 6/1997 | E21B/33/128 |
| GB | 2334046 A | 8/1999 | E21B/4/00 |
| JP | 62153487 | 7/1987 | E21B/43/24 |
| JP | 91033880 | 5/1991 | E21B/43/24 |
| SU | 1160003 | 6/1985 | E21B/17/10 |
| SU | 1218072 | 3/1986 | E21B/33/13 |
| SU | 1270290 | 11/1986 | E21B/29/10 |
| SU | 1346768 | 10/1987 | E21B/34/06 |
| SU | 1717795 | 3/1992 | E21B/34/00 |
| SU | 1730429 | 4/1992 | E21B/33/13 |
| SU | 1812297 | 4/1993 | E21B/17/10 |
| WO | WO 94/03701 | 2/1994 | E21B/43/00 |
| WO | WO 96/01937 | 1/1996 | E21B/33/127 |
| WO | WO 96/21083 | 7/1996 | E21B/43/10 |

* cited by examiner

METHODS OF USING DOWNHOLE POLYMER PLUG

BACKGROUND OF THE INVENTION

1. Field of the Invention

The present invention relates to wellbores, and more specifically, to methods and apparatus for selectively isolating areas such as production zones within the wellbore.

2. Description of the Related Art

After a well has been drilled and the casing is cemented into it, one or more sections of the casing are perforated. These perforations allow for the in-flow of fluids from the formation at one or more subterranean production zones. A production tubing is then inserted and installed into the well for the purpose of conducting fluids from the production zone to the surface.

Sometimes, during the life of the well, the perforations in a particular section of the casing may begin to admit an unacceptable level of contaminants. For example, in the case of an oil well, unacceptable levels of water or sand may enter the wellbore from one or more production zones. Those production zones producing the excessive amount of water or sand must then be plugged or otherwise sealed to prevent the continued entry of water or sand into the wellbore. In some cases, the plugged well still produces fluid from other production zones, while in other cases all production from the well is shut down.

One technique commonly used to seal the unwanted zones involves the creation of a cement plug or lining on the inside surface of the casing. This technique normally requires removal of the production tubing from the well followed by insertion of a temporary packer to isolate the unwanted zone. Cement is then poured down the wellbore on top of the packer and, after curing, forms the desired plug to seal the perforations in the unwanted zone. To restore production from the lower zones of the well, the center of the cement plug must be bored out. Sealing unwanted zones using cement, however, has often proved unsatisfactory because the cement tends to crack and permit water to leak into the production field. Additionally, the removal and reinstallation of the production tubing requires significant time, effort, and cost.

Another prior art technique for sealing of portions of wellbore casings is disclosed in U.S. Pat. No. 5,833,001 issued to Song et al. ("Song"). Song discloses an inflatable downhole device that installs a composite sleeve on the inner surface of a damaged casing at a particular depth. Uncured composite material comprising an epoxy layer having a mixture of resin and a curing agent surrounded by a sealing film are disposed on the outside of the inflatable device. The device is then lowered down through the production tubing to the desired depth. Once at this depth, the device is inflated to press the composite materials against the inner diameter of the casing. The composite materials are then heated under pressure to form a sealing liner which closes off the perforations in the damaged casing.

Expandable steel casings have also been used to restore wellbore integrity when existing casing strings have become damaged or severely corroded. These types of steel casings may provide some advantages where there are high differential pressures across the casing and a high strength liner is necessary. The casings however, are intolerant of changes in wellbore diameter and may become stuck during deployment. The use of these steel casings can involve significant effort and expense because the production tubing has to be pulled from the well before the expandable steel casing and installation equipment can be run down the hole.

Deficiencies also exist in the known methods of plugging a well where it has become damaged beyond repair or has reached the end of its useful life. Before a well is abandoned, state and federal regulations frequently require it to be plugged for safety and environmental purposes. Typically, the well is plugged by simply pumping cement into the wellbore and allowing it to cure. Cement plugs like cement liners, however, have been known to crack and allow fluid to leak through the plug.

Bentonite has also been used in another prior art method for plugging an abandoned well. In such cases, water is poured down the wellbore. Next, hygroscopic bentonite pellets are dropped down the wellbore along with alternating levels of gravel. The bentonite pellets are hydrated by the water, which causes the bentonite to expand and thus seal the well. The hydration of the pellets, however, is oftentimes uncontrollable. For example, when the pellets are dropped down the wellbore they may stick to the sides of the casing or other equipment, and prematurely hydrate, thus clogging the wellbore and preventing effective sealing of the well.

Wireline inflatable plugs have been used to isolate intervals in the wellbore without having to pull the production tubing. Inflatable wireline plugs are not capable of withstanding high differential pressures without making additional runs to dump cement on top of the plug. The inflatable packer used also requires substantial metal reinforcement to withstand even low differential pressures. This makes it difficult to remove or mill up the plug if it is necessary to reenter the interval below the packer.

Therefore, a need exists for a method and apparatus for repairing or plugging a wellbore without having to remove the production tubing and without having the disadvantages associated with conventional methods and apparatuses.

SUMMARY OF THE INVENTION

In one aspect, the present invention is directed to a method of plugging or lining a desired location within a wellbore by reducing the diameter of, and thereby creating stored energy in, a polymer member, then lowering the member to the desired location within the wellbore, and causing a reduction in the stored energy in the member to allow it to expand in diameter a sufficient amount to plug or line the wellbore at the desired location.

In another aspect, the invention relates to the member formed of a polymer having: (i) good long-term thermal stability to enable the member to maintain physical integrity throughout its intended service life; (ii) good chemical stability so that it is able to absorb crude, gas, or other downhole substances without embrittlement; (iii) high deformability so that it does not break during the creation of shape-memory; and (iv) quickly recoverable shape-memory upon the introduction of heat or a solvent capable of reducing the anelastic strain induced in the member

BRIEF DESCRIPTION OF THE DRAWINGS

The present invention is described in detail below with reference to the attached drawing figures, wherein.

DETAILED DESCRIPTION OF THE INVENTION

Figure 1:
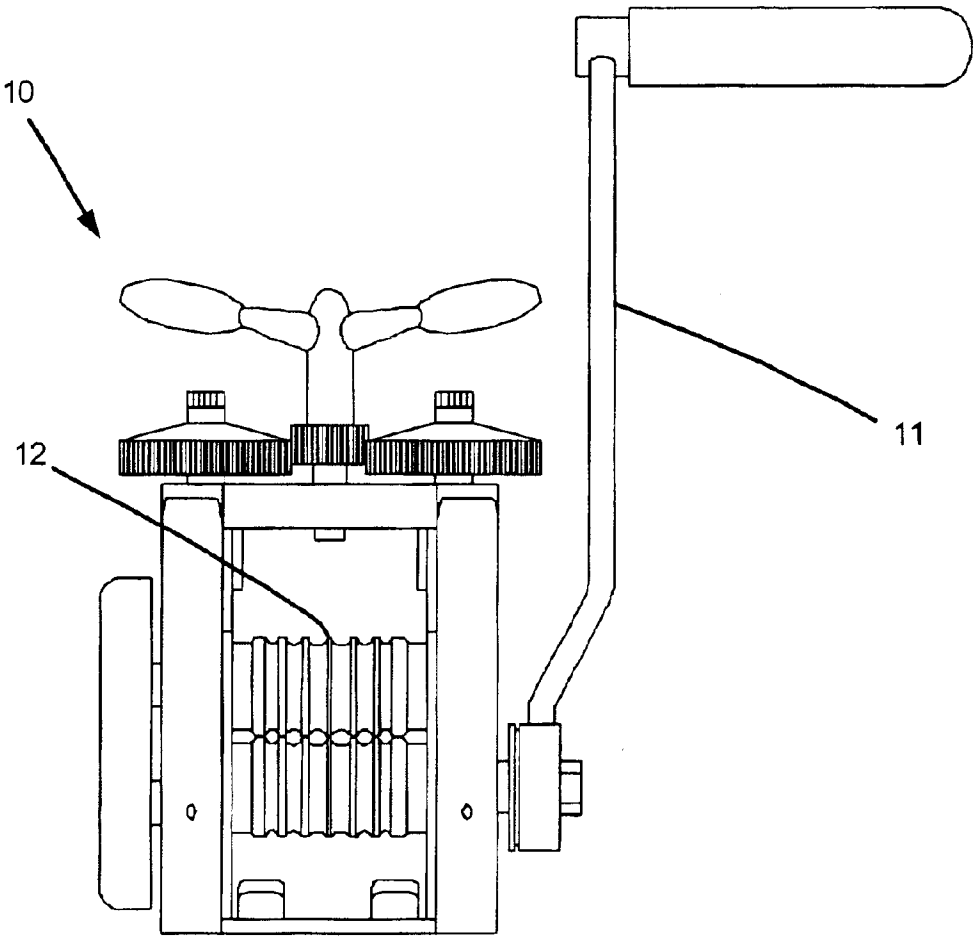
FIG. 1 is an elevation view of a rolling mill useful in reducing the diameter of a polymer member of the present invention.

Thermoplastic polymers can store a large amount of mechanical energy upon deformation. When this energy is released, the anelastic strain of the polymer is recovered, and the polymer will return to its original shape.

Anelastic strain recovery is a kinetic process that generally proceeds more quickly with increasing temperatures. For amorphous polymers, like polystyrene, polycarbonate, polymethyl mathacrylate, the recovery is very fast at temperatures above their glass transition temperatures (Tg). For semi-crystalline polymers, such as polyethylene, PVDF, and Halar, the recovery is rapid at a temperature close to their melting point. Recovery of anelastic strain can also be obtained by exposing the polymers to certain solvents.

The present invention makes use of the anelastic strain recovery properties of particular polymers for plugging or lining a specific zone or location in a wellbore. The method includes providing a polymer member, preferably in the form of a rod or sleeve, that has an original outer diameter larger than the inner diameter of the wellbore or, if present, a casing in the wellbore. The polymer member is then processed to reduce its diameter while storing some of the mechanical energy that will allow the polymer member to expand in diameter upon recovery of the anelastic strain. This processing of the polymer member can take various forms, such as compressing the member by running it through a rolling mill, or by stretching it to reduce its diameter. The diameter of the polymer member is reduced to an extent such that the member can be lowered in the wellbore on a wire line or coiled tubing. For example, if production tubing is present, the outer diameter of the polymer member must be at least slightly less than the inner diameter of the production tubing. Once the member has been lowered to the desired location in the wellbore, the anelastic strain is recovered, at least in part, to cause the polymer member to expand in diameter and press against the internal surface of the wellbore or casing.

The expansion of the polymer member in the wellbore is accomplished in one embodiment by causing the member to become heated. The existent wellbore temperatures alone will often be sufficient to recover the anelastic strain in the polymer member and cause it to expand over a preselected time period and seal against the wellbore or casing with sufficient force to withstand the differential pressures within the wellbore. If necessary or desired, a supplemental or independent heat source could be used to cause or accelerate recovery of the anelastic strain. In another embodiment, solvents can be used to recover the anelastic strain.

Because the original diameter of the polymer member is greater than the diameter of the wellbore or casing, the polymer member will press against an inner surface of the wellbore or casing once the anelastic strain is sufficiently recovered. In the case of the solid rod or cylinder, the polymer member will plug the well. In the case of a tubular liner, the member will line the inner surface of the wellbore or casing to plug the perforations in that location, but allow the flow of fluids such as hydrocarbons from below the member upwards through the open center of the member towards the production tubing. The liner thus allows unwanted zones to be isolated from the desired production zones and the plug can be used to seal the wellbore to stop all or selected portions of production from the well.

Sizing the Member

For either a solid rod member used for plugging operations or a sleeve member used for zone isolation applications, the expanded polymer member should deliver a sufficient force against the wellbore or casing to provide proper pressure sealing. The sealing pressure for a particular polymer may be experimentally determined in the following manner.

First, a sealing pressure transducer is constructed by attaching a strain gauge to the outside diameter of a piece of stainless steel tubing and then using a strain gage signal conditioner to measure the hoop strain.

Next, a polymer member is deformed to a reduced diameter to create anelastic strain and is then inserted in the steel tubing and heated. The heat causes the polymer member to expand as the anelastic strain is recovered. As the polymer member expands and touches the steel inner diameter, hoop strain readings are taken. The sealing pressure exerted on the inner steel surface can be obtained from the hoop strain readings using the following analytical equation:

$$P=(E\epsilon/2)[(b^2-a^2)/(1-\nu)a^2]$$

where P=sealing pressure;

$\epsilon$=hoop strain;

E=the modulus of the steel tube (29 msi for stainless steel);

a=the inner radius of the steel tubing;

b=the outer radius of the steel tubing, and $\nu$=Poisson ratio (0.33 for steel).

Eventually, the steel tube hoop strain will increase to reach a plateau. After reaching the plateau, the sealing pressure can be maintained without any sign of relaxation. The plateau sealing pressure obtained will vary with the type of the polymers. After the plateau sealing pressure has been determined, it may be used to determine an appropriate length for the polymer member.

The appropriate length for a polymer member used for the purpose of plugging a wellbore may be calculated using the following equation:

$$L=D\ P/(48S\mu)$$

where L=plug length in feet;

D=the inner diameter of the casing in inches;

P=the pressure differential in psi;

S=the sealing pressure in psi (200 psi for Hylar FX); and $\mu$=Coefficient of friction (0.3 for polymer/steel).

Table I shows the calculated plug lengths using Hylar FX polymer for different downhole pressures and casing internal diameters.

TABLE I

Calculated Through-Tubing Hylar FX Plug Length

| Downhole Pressure P, psi | Casing ID D, in | Plug Length L, ft |
|---|---|---|
| 5,000 | 7 | 12 |
| 5,000 | 5 | 8.7 |
| 1,000 | 7 | 2.4 |
| 1,000 | 5 | 1.7 |

Other materials besides Hylar FX could also be used, as will be described later. Regardless, the above equation may be used to calculate polymer plug lengths provided that the sealing pressure and coefficient of friction for that polymer are known.

Selecting a Polymer

In order to be effectively used in the method of the present invention, the polymer selected for the polymer member should have the following basic characteristics. First, it should have good long term thermal stability so that the polymer is able to maintain its physical integrity without chain scission during its intended service life. Second, the polymer should have good chemical stability. Thus, it can absorb crude, gas, and other downhole chemicals without embrittlement or significant degradation. Third, the polymer should be able to endure significant elongation. It should be stretchable to between 300 and 800% of its original length without breaking. Finally, anelastic strain created in the polymer should be recoverable in less than 3 hours at a downhole temperature of 100 to 450° F.

The following polymers have been found to meet the above four requirements in given circumstances. The wellbore temperature and pressure differential will determine which polymer should be selected for a given application. Some examples of commercially available polymers are shown in Table II below.

TABLE II

Some Examples of Shape Memory Polymers

| Product name | Polymer Type | Polymer Melting Temp, F. | Thermal Recovery Temp, F. | Size Reduction Ratio | Thermal Recovery Ratio | Polymer Expansion Ratio |
|---|---|---|---|---|---|---|
| Hylar FX | PVDF | 285 | 270 | 2.1 | 1 | 2.1 |
| Solef PVDF 21508/0003 | PVDF | 275 | 260 | 2.6 | 0.96 | 2.5 |
| Halar XPH 353 | ECTFE | | 320 | 2.0 | 1 | 2.0 |
| Attane 4201 | ULDPE | 253 | 248 | 2.6 | 1 | 2.6 |
| Affinity PF 1140 | Polyolefin plastmer | 205 | 194 | 2.4 | 1 | 2.4 |
| LDPE | LDPE | | 226 | 2.1 | 1 | 2.1 |
| LLDPE | LLDPE | | 246 | 2.1 | 1 | 2.1 |
| Canusa-CPS | XPE | 245 | 250 | 3.0 | 1 | 3.0 |

Size Reduction Ratio = Diameter prior to deformation/Diameter after deformation
Thermal Recovery Ratio = Recovered diameter/Diameter prior to deformation
Expansion Ratio = Recovered diameter/Diameter after deformation = Size Reduction Ratio × Thermal Recovery Ratio Amorphous thermoplastic polymers can make full recovery of any anelastic strain created in them. The anelastic strain in semi-crystalline thermoplastic polymers is also recoverable, provided its crystallinity is relatively low and it has entangled molecular morphology. Some homopolymers can be copolymerized with another co-monomer to reduce the degree of crystallinity and increase the elongation. Some high ductility polymers are also potentially useable in the present invention. It is important to note, however, that numerous polymers or other materials in which shape-memory may be created could also be used besides the ones specifically set forth herein and still fall within the scope of the present invention.

Polyvinylidene fluoride polymer (PVDF) has proven effective for use in the present invention. PVDF is a fluoropolymer with alternating $CH_2$ and $CF_2$ groups and has good chemical resistance.

A specific example of a PVDF polymer usable in the present the invention is Hylar FX polymer that is commercially available from Solvay Solexis, Inc. in Thorofare, N.J. ("Solvay"). Hylar FX has a low degree of crystallinity and high ductility. Solef PVDF 21508/0003 is another PVDF copolymer supplied by Solvay that may be used.

Another example of a useful polymer is Halar ECTFE polymer, which is an alternating copolymer of ethylene and chlorotrifluoroethylene supplied by Solvay. Halar ECTFE polymer has the added advantage of chemically bonding to a steel substrate. Halar XPH 353 is a terpolymer also supplied by Solvay that has a low crystallinity and high elongation to break.

Low density polyethylene polymer (LDPE) is another example of a suitable polymer to be used in the present invention. LDPE polymer is produced in many forms, each of which has different properties resulting from variations in structure. The basic building block of LDPE polymer is the ethylene (—$CH_2$—)n monomer. The density for the crystalline phase is 1.014 g/cc and for the amorphous phase is 0.84 g/cc. The lower the polyethylene density, the greater the percentage of the amorphous phase in the polymer. LDPE polymer contains both short and long chain branching with low density (0.915–0.935 g/cc), degree of crystallinity, and melting point (108–115° C.). Its branch chain length is 200 to 300 carbons. Its number of long chain branch per polyethylene molecular chain is 3 to 7.

Another shape memory polymer is linear low-density polyethylene polymer (LLDPE). LLDPE is produced by copolymerizing ethylene with an alpha-olefin and has a density of 0.910–0.925 g/cc and melting point (125° C.). It contains short chain branching and its anelastic strain can be recovered. There are many LLDPE suppliers and products. For example, ATTANE 4201 is a copolymer of ethylene and octane supplied by Dow Chemical, Inc. ("Dow") located in Midland, Mich. ATTANE 4201 has a density of 0.9120 g/cc, which is lower than that of LDPE polymers, and is classified as ultra low density polyethylene.

Polyolefin plastomers is another example of a suitable shape memory polymer. AFFINITY PF 1140 is an ethylene-alpha olefin copolymer with a very low density of 0.8965 g/cc supplied by Dow.

Crosslinked polyethylene polymer (XPE) is another shape memory polymer for the downhole applications. It can maintain a certain amount of melt strength even above the melting point of its crystalline phase. It also has good chemical resistance to the downhole environment. XPE rod or liner can reduce its diameter by stretching around its melting point of its crystalline phase. Its stretched molecular morphology can be frozen when the XPE material is cooled to room temperature under tensile load. The deformed molecular structure is locked up by the rigid crystalline phase. Upon reheating to its melting temperature, the deformed molecular structure can spring back to its original shape.

The polyethylene may be cross linked by at least three methods. First, the crosslinking may be done by beta irradiation. Beta irradiation exposes the polyethylene to high-energy electrons. This makes the polyethylene most suitable when used in thin sections. Second, peroxide may be mixed with the polyethylene during the extrusion process during manufacture. The elevated temperatures during extrusion cause the peroxide molecules to break up, producing free radicals. Pairs of these free radicals will then combine and cross-link two chains. A third method that may be used is to graft a reactive silane molecule to the backbone of the polyethylene. Any of these three methods will effectively crosslink the polyethylene.

The selection of the preferred polymer to be used for a specific downhole application in practicing the present invention may be done by determining the particular downhole properties, such as wellbore temperature and chemical environment. For example, if the wellbore temperature at the desired location is 280° F., Hylar FX PVDF polymer can be used because it has a thermal recovery temperature of 270° F., which is below the wellbore temperature, and a melt temperature of 285° F., which is above the wellbore temperature. As a result, the polymer member would expand to recover its shape-memory without melting.

Suitable solvents that may be used to recover the anelastic strain include methylethyl ketone, tetrahydrofuran, and betabutyrolacetone for PVDF polymers and cyclohexanol for Affinity EG 8100 plastomer.

Creating Anelastic Strain in the Polymer Member

Once the appropriate size and type of the shape memory polymer member has been selected, the polymer member can be deformed in at least two different ways—compressibly reducing it or by tensile stretching.

A hand rolling mill machine 10 useful in compressing the polymer member is shown in FIG. 1. The rolling mill 10 has a manual crank arm 11 which is used to manually drive a pair of rollers 12. The rollers 12 rotate counter clockwise to one another when viewed in a cross-sectional plane. Though the rollers 12 shown are manually driven, alternatively, they could be powered by a motor. One example of such a motor-powered arrangement is disclosed in U.S. Pat. No. 4,380,916 issued to Tanaka. However, other kinds of rolling mill arrangements could be used as well and still fall within the scope of the invention.

Figure 2:
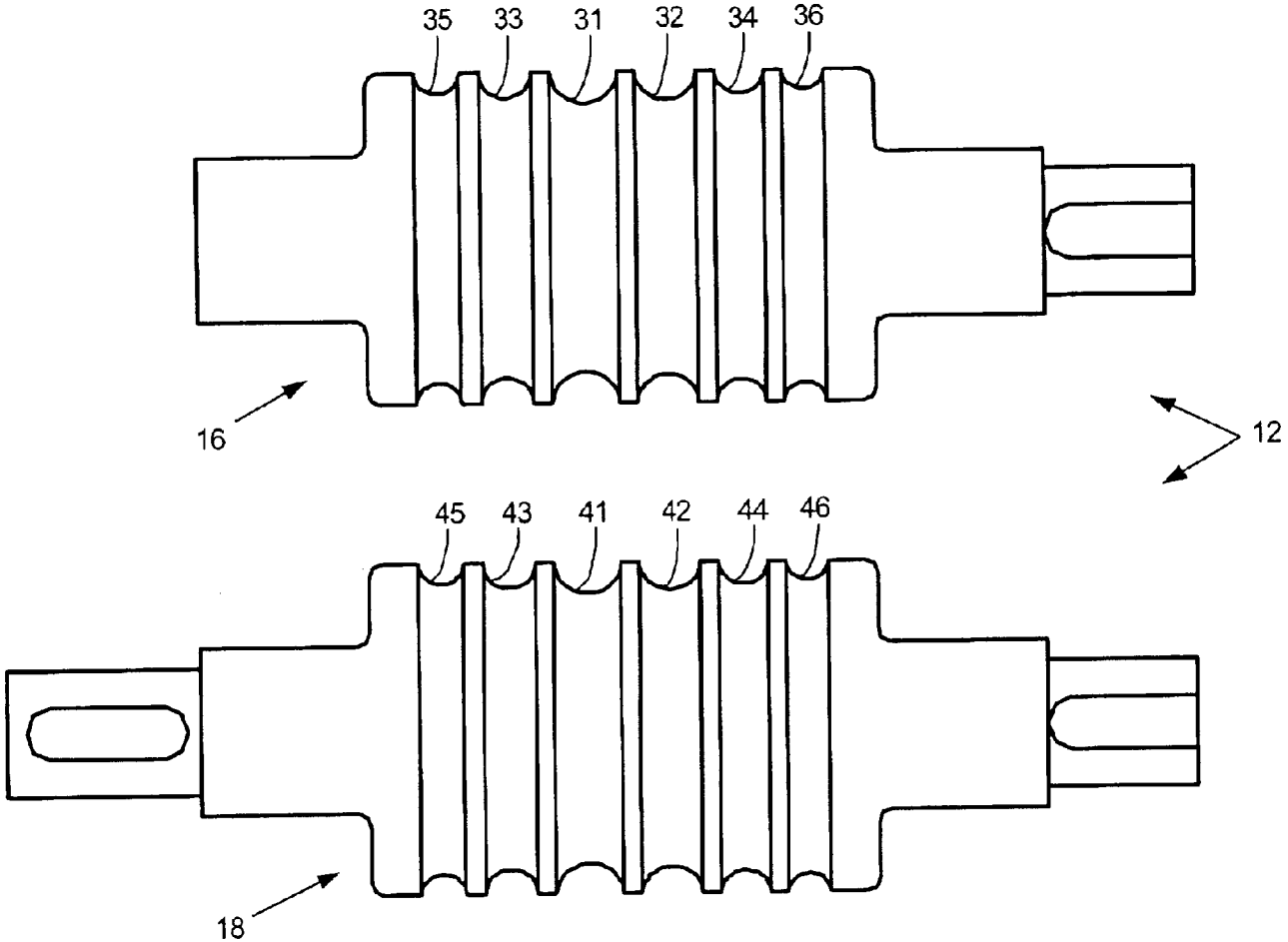
FIG. 2 is an elevation view of a first set of rollers used in the rolling mill shown in FIG. 1.

FIG. 2 shows the details of the rollers 12. An upper roller 16 and a lower roller 18 each have a plurality of grooves disposed thereon. Grooves 31–36 on roller 16 correspond with grooves 41–46 on roller 18, respectively. In operation, roller 16 and roller 18 will be in close proximity to one another such that the grooves will form a plurality of elliptically shaped apertures therebetween. These apertures allow a polymer member to pass therethrough. The apertures formed are of progressively smaller sizes so that material passed therethrough may be made progressively smaller in diameter. As can be seen from FIG. 2, the size of the next aperture is always smaller than the preceding one. More specifically. The polymer member is first passed through the aperture defined by grooves 31 and 41 to reduce its diameter to a preselected value. The polymer member is next passed through the aperture defined by grooves 32 and 42 to reduce its diameter a further incremental amount. Next, the polymer member is passed through the aperture defined by grooves 33 and 43 which define an aperture smaller than the one defined by grooves 32 and 42. In the same manner, the polymer member is rolled through grooves 34 and 44, then 35 and 45, and finally 36 and 46. As a result of this processing using the rolling mill 10, the polymer member becomes incrementally compressed and reduced in diameter, creating stored energy in the polymer member that can be recovered under preselected conditions to cause expansion of the polymer member.

Figure 3:
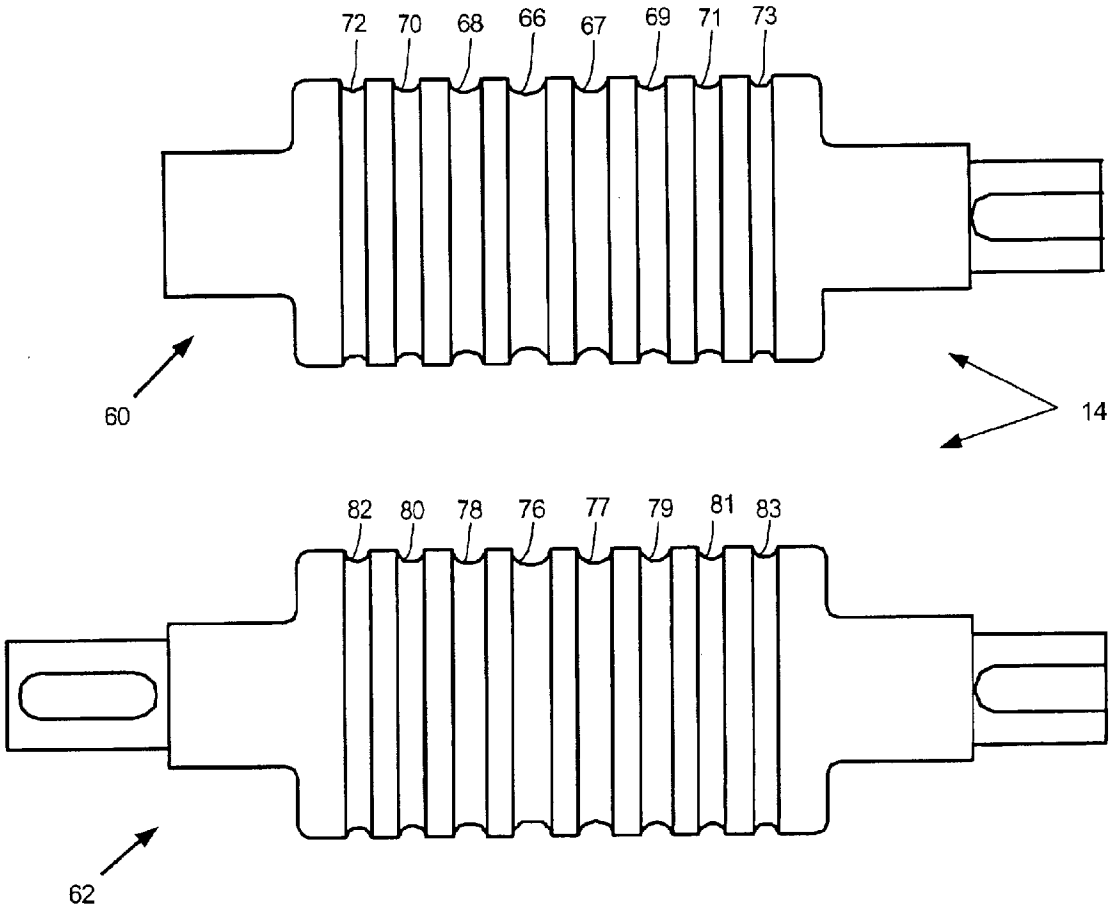
FIG. 3 is an elevation view of a second set of rollers used in the rolling mill shown in FIG. 1.

If a single pair of rollers 16 and 18, such as those disclosed in FIG. 2, is insufficient to adequately reduce the diameter of the polymer member, an additional roller arrangement, such as that shown in FIG. 3 will be used. Referring to FIG. 3, a second pair of rollers 14 is used to reduce the diameter of the polymer member even further. The second pair 14 of rollers works the same way as first pair of rollers 12. A top roller 60 and bottom roller 62 in the second pair of rollers 14 each includes a plurality of grooves. With respect to roller 60, grooves 66–73 are numbered from largest to smallest. Likewise, grooves 76–83 on roller 62 are the numbered from largest to smallest. Again, like the first pair of rollers 12, second pair of rollers 14 are held in close tolerances with one another so as to define a plurality of elliptical shaped apertures between the two rollers. Again, like with the first pair, the polymer member is run successively through the increasingly smaller apertures until the desire diameter is obtained.

Table III below shows the elliptical groove dimensions for a reduced scale model of the mill 10:

TABLE III

Dimensions for Elliptical Grooves

| Rolling Mill | Groove Nos. | Major Axis (inches) | Minor Axis (inches) |
|---|---|---|---|
| Roller Set #12 | 31,41 | 0.500 | 0.390 |
| | 32,42 | 0.450 | 0.351 |
| | 33,43 | 0.407 | 0.317 |
| | 34,44 | 0.37 | 0.288 |
| | 35,45 | 0.337 | 0.263 |
| | 36,46 | 0.309 | 0.241 |
| Roller Set #14 | 66,76 | 0.285 | 0.222 |
| | 67,77 | 0.264 | 0.206 |
| | 68,78 | 0.246 | 0.192 |
| | 69,79 | 0.23 | 0.179 |
| | 70,80 | 0.216 | 0.168 |
| | 71,81 | 0.204 | 0.159 |
| | 72,82 | 0.193 | 0.150 |
| | 73,83 | 0.184 | 0.143 |

A rolling mill that would be used in the commercial application would normally have much larger dimensions than that illustrated in Table III, however the relative sizes of the above dimensions could remain the same. The dimensions for a larger mill can be readily determined by simply multiplying all the dimensions provided above by a particular factor. For example, multiplying by 10 creates a mill having first groove dimensions of 5 inches by 3.90 inches and last groove dimensions of 1.84 inches by 1.43 inches. Other groove proportions could, however, be used and still be within the scope of the invention. Additionally, any number of grooves could be used as well and still fall within the scope of the invention.

From the dimensions provided for the last set of grooves, 73 and 83, it can be seen that the member will be reduced in diameter by almost a third after it has been run through all the grooves. This can be seen to meet the expansion ratio requirements shown in Table II.

Figure 4:
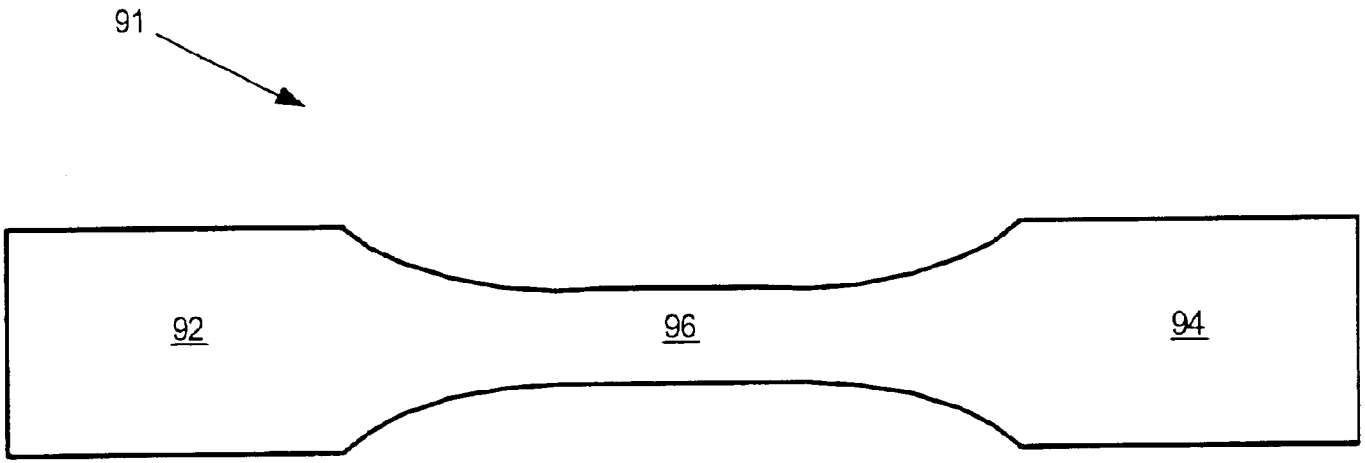
FIG. 4 is an elevation view of a polymer member of the present invention prior to its stretching.

As an alternative to using rolling mill 10, tensile stretching of the polymer member may be performed to obtain the desired reduction in diameter of the polymer member. Tensile stretching may be done using a hydraulic or gear-type tensile machine with wedge grips (not shown). For example, as shown in FIG. 4, a polymer member 91 can be stretched by a pair of wedge grips on both ends of the polymer 92 and 94. The wedge grips will extend the midsection of the member 96 until its diameter is sufficiently reduced. Polymer member 91 is then be removed from the wedge grips, and portions 92 and 94 severed, leaving only midsection 96 to be used as the polymer member which is to be lowered into the well for plugging or lining purposes.

Restoring Shape Memory to the Member

Once mechanical energy has been stored in the polymer member, the polymer member is then ready for deployment in the wellbore. This process is illustrated with reference to FIGS. 5–7.

Figures 5, 6, 7:
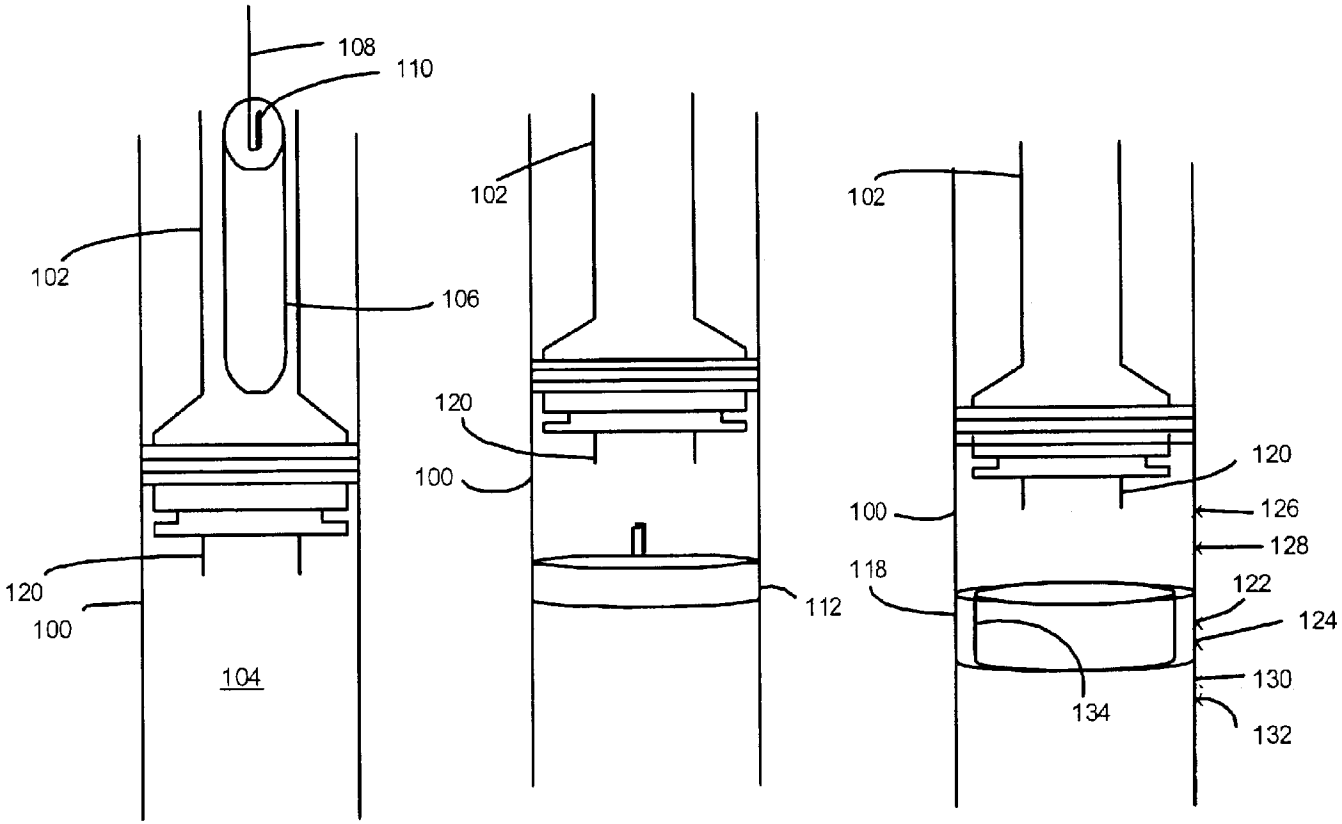
FIG. 5 is a fragmentary elevation view of a wellbore showing a shape-memory polymer member of the present invention being lowered through a production tubing for introduction into a desired location within the wellbore.
FIG. 6 is a fragmentary elevation view of the wellbore plug created after the shape-memory polymer member has expanded after recovery of at least a portion of the anelastic strain in the polymer members.
FIG. 7 is a fragmentary elevation view of an alternate embodiment of the present invention in which a shape-memory polymer member has been used to create a liner in the wellbore to seal off perforations in selected areas of the wellbore.

As can be seen in FIG. 5, the typical wellbore arrangement includes a wellbore or casing 100 with production tubing 102 disposed therein. At the lowermost end of the production tubing 102 is a nipple 120 which normally has the smallest diametric opening of any portion of the production tubing 102. Because of this, a polymer member 106 that is to be lowered through the tubing 102 to plug or line the wellbore or casing 100 at a desired location 104 below the production tubing 102 must have an outer diameter less than the inner diameter of the nipple 120. The diameter of the nipple 120 in most production tubing assemblies is less than half of the diameter of the wellbore casing. Therefore, the polymeric material selected for the polymer member 106 must have an expansion ratio which enables it to pass through the nipple 120 and then expand sufficiently to create the necessary pressure seal against the inside of the wellbore or casing 100. Typically, this requires member 106 to have an expansion ratio of at least 2. Table IV below discloses some typical nipple internal diameters in relation to the internal diameter of the casing, and also discloses the minimum expansion ratio required of the polymer member 106 in order to perform as desired.

TABLE IV

Production Tubing and Casing Sizes

| Tubing Size (inches) | Min Nipple ID (inches) | Casing Size (inches) | Min Casing ID (inches) | Expansion Ratio |
|---|---|---|---|---|
| 2⅞ | 2.205 | 7 | 6.004 to 6.366 | 2.9 |
| 2⅜ | 1.791 | 5 | 4.408 | 2.5 |
| 2⅞ | 2.205 | 5 | 4.408 | 2.0 |
| 3½ | 2.635 | 7 | 6.004 to 6.366 | 2.4 |

Additionally, the polymer member 106 should be constructed of a polymer which recovers its anelastic strain at a desired rate when exposed to the specific wellbore conditions at the location 104 in which it is to be placed, as described above.

If the polymer member 106 is to be used to plug the well, member 106 will be a solid rod or cylinder in which shape memory or stored energy has been created such as by the processes described above. Where polymer member 106 is used to seal off the perforations in a particular zone while permitting continued production from underlying zones, it will be a sleeve of the selected polymer material having shape memory. In either case, the member 106 will be lowered down through the production tubing 102 on a wire line 108 which is releasably attached to the polymer member 106 by a connection or hook 110 in a manner known to those skilled in the art.

Once polymer member 106 has reached desired location 104, in one embodiment, the elevated temperatures induced or already present at location 104 will begin to cause the release of anelastic strain within member 106, and it will begin to expand in diameter. Alternatively or additionally, the member 106 may be exposed to a solvent introduced at location 104 to cause at least partial recovery of the anelastic strain. Eventually, polymer member 106 will expand to the extent that it engages the inner surface of casing 100 and bears against it. Once the polymer comprising member 106 has expanded sufficiently, wireline 108 is detached from the member 106. Member 106 then remains secured in place by the pressure it creates on the inner wall of casing 100. Notably, because of the resilient nature of the polymer member 106, it readily conforms to any irregularities in the inner wall of casing 100.

FIG. 6 shows the results of the expansion of the polymer member 106 when a solid member 112 is used to plug the wellbore. In this embodiment, the polymer member 106 will sealingly engage the inner surface of the casing 100 when it is expanded, and because it is solid, the flow of any fluids from below the member coming up through the casing will be blocked.

FIG. 7 shows the result of the process when a sleeve-like polymer member 118 is expanded to seal a particular zone within the wellbore. As can be seen from FIG. 7, a pair of perforations, 122 and 124 at the location in which the member 118 seals the inside of the wellbore or casing will be plugged by the polymer member 118 when it expands. Other perforations 126 and 128 above the polymer member 118 as well as perforations 130 and 132 below the polymer member 118 will not be sealed off and will continue in production. Thus, selectively sealing perforations 122 and 124, such as to prevent excessive amount of water coming from that zone, does not affect the desired production of water, oil, gas or other fluids from upper or lower zones.

From the foregoing, it will be seen that this invention is one well adapted to attain all the ends and objectives hereinabove set forth together with other advantages which are inherent to the methods disclosed.

It will be understood that certain steps have independent utility and may be employed without reference to other disclosed steps. This is contemplated by and is within the scope of the invention.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A method of sealing an inner surface of a wellbore, said method comprising the steps of:

providing a member having a preselected shape with a diametrical dimension and an axial dimension, said member being constructed of a polymer material in which stored energy may be imparted and subsequently recovered at least in part, said material further having a crystalline melting temperature;

subjecting said member to forces causing a reduction in said diametrical dimension and an increase in said axial dimension while imparting stored energy in said member, while not raising said member material above its crystalline melting temperature;

lowering said member into the wellbore to a desired location; and subjecting said member to conditions in the wellbore at said desired location to cause at least partial release of said stored energy and allow said member to expand to sealingly engage the inner surface of the wellbore at the desired location.

2. The method of claim 1, wherein said step of subjecting said member to conditions to cause said at least partial release of said stored energy comprises heating said member at said desired location.

3. The method of claim 1, wherein said step of subjecting said member to conditions to cause said at least partial release of said stored energy comprises exposing said member to a solvent at said desired location.

4. The method of claims 1–3, wherein said step of providing a member comprises providing a member constructed of a polymer.

5. The method of claim 4, wherein said step of providing a member comprises providing a member constructed of a polymer selected from the group consisting of: polyvinylidene fluoride, an alternating copolymer of ethylene and chlorotrifluoroethylene, low density polyethylene, linear low density polyethylene, polyolefin plastomer, and cross-linked polyethylene.

6. The method of claim 1, wherein said step of sealingly engaging the inner surface of the wellbore comprises sealingly engaging an inner surface of a casing lining said wellbore.

7. The method of claim 1, wherein said step of lowering said member into the wellbore comprises lowering said member through a production tubing positioned within said wellbore.

8. The method of claim 1, wherein said step of subjecting said member to forces comprises rolling said member to a reduced diameter.

9. The method of claim 8, wherein said step of rolling said member comprises:

providing pairs of opposing first and second rollers;

in each pair of rollers, said first roller having at least one annular groove thereon, said second roller having at least one groove thereon, said at least one annular groove on said first roller and said annular groove on said second roller defining between them an elliptical aperture;

passing the member through the elliptical aperture defined by the rollers to reduce the cross sectional area of the member and thus create stored energy in the member.

10. The method of claim 1, wherein the member is created by:

providing a piece having a first end having a grippable portion, a midsection, and a second end having a grippable portion;

stretching out the midsection by pulling out on the first and second ends using the grippable portions on each;

removing the grippable portions; and using the midsection as the member.

11. A method of plugging a wellbore or casing lining said wellbore, said method comprising the steps of:

selecting a material in which stored energy may be instilled and later released by the introduction of energy;

constructing a solid, rod-shaped member of said material;

creating anelastic strain in the member by stretching and/or compressing the member;

lowering said member into the wellbore to a desired location within the wellbore;

releasing the stored energy in said member by allowing heat to be introduced into said member, thus causing the member to expand to sealingly engage an inner surface of the wellbore or said casing at the desired location and thus plug the wellbore or casing at the desired location.

12. The method of claim 11, wherein said step of lowering said member into the wellbore comprises lowering said member through a production tubing positioned within said wellbore.

13. The method of claim 11, wherein said step of releasing the stored energy in said member comprises heating said member.

14. The method of claim 11, wherein said step of releasing the stored energy in said member comprises contact said member with a solvent.

15. A method of sealing off a particular zone in a wellbore or a casing lining said wellbore, said method comprising the steps of:

selecting a polymer material in which stored energy may be instilled and later released by the introduction of heat, said material having a crystalline melting temperature;

constructing a sleeve-shaped member of said material;

creating stored energy in said member by stretching and/or compressing the member, while not raising said material above its crystalline melting temperature;

lowering said member into the wellbore to a desired location within the wellbore;

releasing the stored energy in said member by allowing heat to be introduced into said member, thus causing the member to expand to sealingly engage an inner surface of the wellbore or casing at the desired location while providing an axial passage for the flow of fluids upward through the member.

16. The method of claim 15, wherein said step of lowering said member into the wellbore comprises lowering said member through a production tubing positioned within said wellbore.

17. The method of claim 15, wherein said step of releasing the stored energy in said member comprises heating said member.

18. The method of claim 15, wherein said step of releasing the stored energy in said member comprises contact said member with a solvent.

* * * * *